United States Patent [19]

Cook et al.

[11] Patent Number: 4,682,801

[45] Date of Patent: Jul. 28, 1987

[54] ELECTROMAGNET ACCESS CONTROL CIRCUIT

[75] Inventors: Robert C. Cook, Redondo Beach; Sasson Toeg, Beverly Hills, both of Calif.

[73] Assignee: Securitron-Magnalock Corp., Torrance, Calif.

[21] Appl. No.: 646,626

[22] Filed: Aug. 31, 1984

[51] Int. Cl.[4] ..... E05C 17/56

[52] U.S. Cl. ..... 292/251.5; 361/144; 292/92

[58] Field of Search ..... 361/156, 144; 307/101; 292/251.5, 201, 144, 92; 70/280–282, 274

[56] References Cited

U.S. PATENT DOCUMENTS

| | | | |
|---|---|---|---|
| 3,036,245 | 5/1962 | Fourey | 361/144 |
| 3,618,066 | 11/1971 | Brommont | 361/144 X |
| 3,730,317 | 5/1973 | Jaeschke | 192/84 R |
| 3,859,571 | 1/1975 | Strobl et al. | 361/144 |
| 3,931,551 | 1/1976 | Holt | 361/156 |
| 4,318,155 | 3/1982 | Thomas | 361/159 X |
| 4,439,808 | 3/1984 | Gillham | 361/144 |

*Primary Examiner*—Richard E. Moore

*Attorney, Agent, or Firm*—Poms, Smith, Lande & Rose

[57] ABSTRACT

An electromagnetic lock for doors includes a large electromagnet mounted on the door frame, and a strike plate or armature secured to the door. A double-throw, double-pole type of relay or other switching circuit serves to selectively connect the electromagnet to receive rectified current when it is energized, and to receive a reverse pulse from a large capacitor when the door circuitry is de-energized. The large capacitor is charged to the same voltage as the electromagnet to insure full reversal of the magnetic domains to prevent residual magnetism. The double-throw, double-pole switch may be actuated by a high speed relay to insure timely switching of the contacts to apply reverse current from the capacitor to the electromagnet. The relay coil may be a latching relay which is selectively actuated in one direction while the circuit is energized, and is reversed as the electromagnet is discharged, so that it draws no current except when it is being switched on. A diode is provided to prevent oscillation of the circuit including the electromagnet and the large capacitor, as well as to block inductive kickback.

16 Claims, 5 Drawing Figures

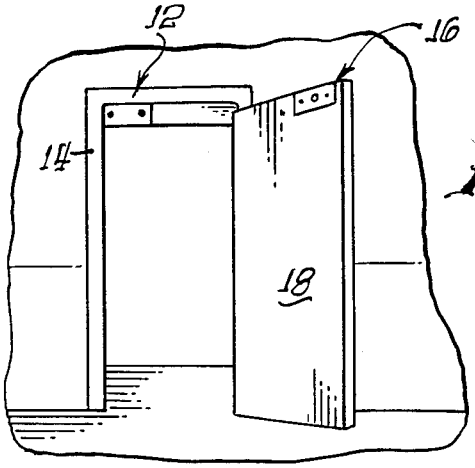
FIG. 1.
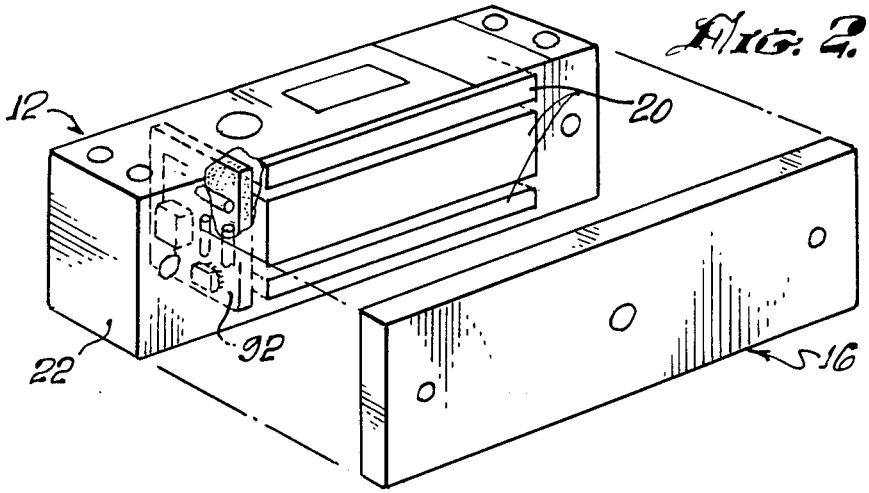
FIG. 2.
FIG. 3.
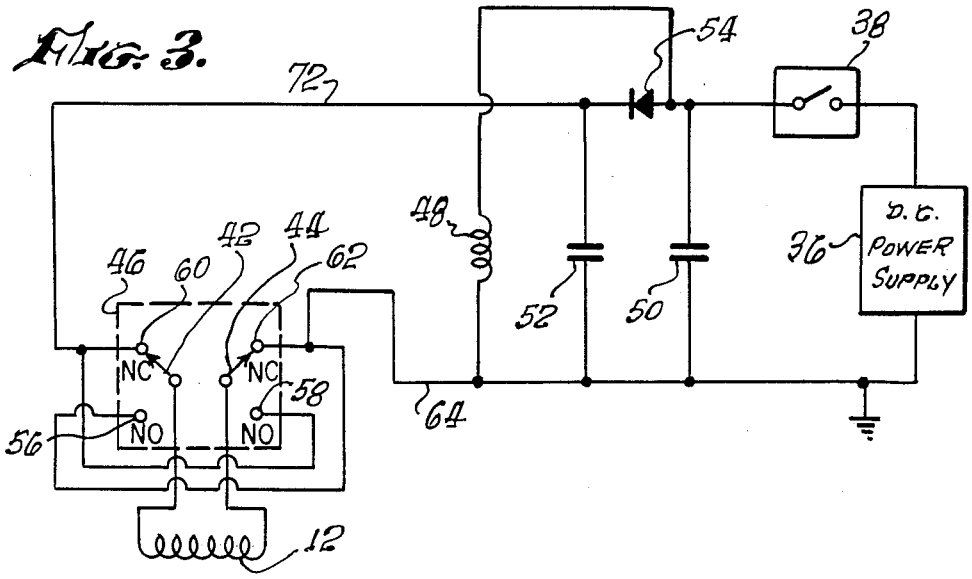

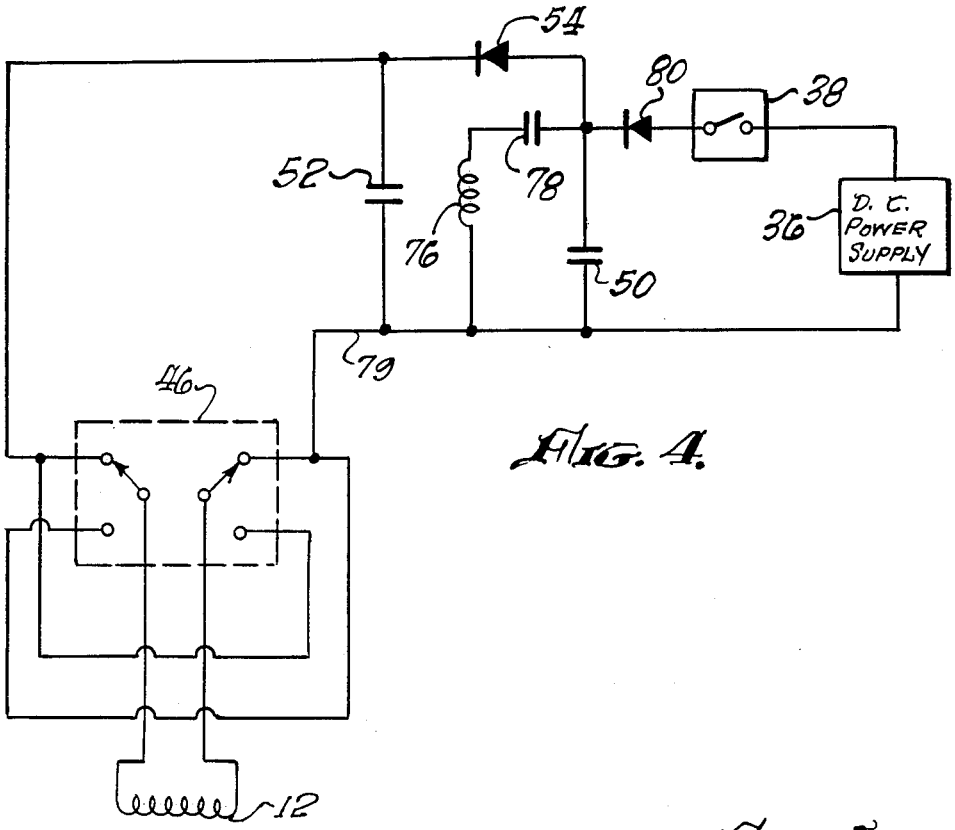
FIG. 4.
FIG. 5.
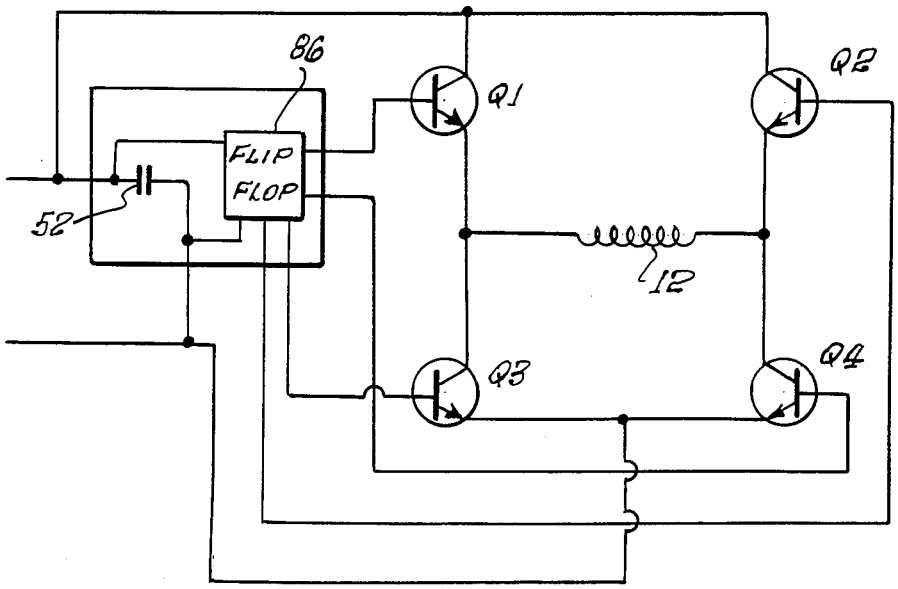

ELECTROMAGNET ACCESS CONTROL CIRCUIT

FIELD OF THE INVENTION

This invention relates to electrical circuits for controlling electromagnets, and more particularly to electromagnetic circuits for the large electromagnets employed in access control systems.

BACKGROUND OF THE INVENTION

In the field of control circuits for electromagnetic door locks, there have been several problems, including (1) residual magnetism, (2) inductive kick-back and (3) relatively slow release. Residual magnetism is an effect which is always found in electromagnets. When power to the magnet is cut off, the magnet continues to hold with a percentage of its energized force. The level of the remaining holding force involves residual magnetism or magnetic remenance, and is most prominently a function of the material used in the core of the electromagnet and the armature. The presence of residual magnetism in a magnetic lock will tend to hold the door closed so that the door appears to "stick" when a person uses it after the magnet has been de-energized. A weak or handicapped person may not be able to open the door at all. Regarding the second problem, that of inductive kick-back, a large electromagnet, such as is required for a practical magnetic lock, uses a large coil; and when the magnetic field collapses on cut-off, a considerable reverse voltage kick-back will appear on the power wires. This reverse kick-back is characterized by a high peak, typically in excess of 1,000 volts when a 12 volt or a 24 volt dc circuit is employed, and the pulse involves considerable total power. Since magnetic locks are used as part of an electronic security and control system, this kick-back pulse can destroy semiconductor devices located elsewhere in the control system. The pulse can also result in the application of a substantial shock to persons who happen to e touching or working on the circuits at the time the electromagnet is de-energized.

Concerning the third problem of release speed, an electromagnet of the size necessary for a practical magnetic door lock does not release instantaneously when the power to it is cut off. The magnetic field typically takes about ½ second to dissipate to its residual level following the cut-off of power. Magnetic locks are often used on emergency exit doors because they will not jam when power to them is cut off. With respect to the outside of the emergency exit door, no entry is possible because of the magnetic lock. However, on the inside, a mechanical switch is typically provided as part of the panic bar release mechanism, such that a person wishing to leave presses the panic bar, thus turning off the power to the magnetic lock. In an emergency situation it can be expected that a person would run at the emergency exit door. The one-half second release time would literally cause the person to re-bound from the door, possibly giving rise to the idea that the door was not usable. This of course could be life threatening in a case of a fire emergency. Ideally, a magnetic lock used on such an emergency exit door would release instantaneously such that a person could run at the door, depressing the panic bar, and could quickly get out.

Accordingly, principal objects of the present invention are to overcome these problems as outlined above, and avoid the sticking which is characteristic of residual magnetism, suppressing inductive kick-back to avoid the damage of associated electronic equipment, and to greatly increase the release speed for electromagnetic door locks. A further object of the present invention is to provide such a circuit which is simple and inexpensive while still effectively solving these problems outlined hereinabove.

SUMMARY OF THE INVENTION

In accordance with one specific illustrative circuit illustrating the principles of the present invention, a large door lock type electromagnet is selectively coupled to two different circuits by a double-pole, double-throw type of switching circuit. When the door lock circuit is energized, rectified voltage is applied both to charge a large capacitor and also to energize the electromagnet, both with the same voltage level. When the power to the circuit is cut off, the double pole, double throw switch switches very rapidly, in a time frame of about 1–3 milliseconds, and the large capacitor is reversed to discharge through the electromagnet precisely canceling residual magnetism. A series connected diode is provided to prevent the oscillation of current in the circuit including the large capacitor and the electromagnet, and to block inductive kickback.

In accordance with an additional feature of the invention, a polarized latching relay is provided which operates a double pole, double throw switch in one direction as current is turned on to the electromagnet circuit; and operates the switch in the opposite direction as the electromagnet discharges. A capacitor is connected in series with the relay coil so that current only flows through the relay coil upon energization or turn-off of the circuit.

In accordance with another aspect of the invention, the large capacitor is charged to the same voltage as the electromagnet, so that the permanent magnet domains within the core and armature of the electromagnet are effectively reversed or cancelled out in their magnetic moment, so that no residual magnetism is present.

In accordance with another aspect of the present invention, the double pole, double throw type of switching action may be implemented by transistors, which may be operated to one state or the other under the control of a bistable flip-flop or multivibrator. The state of the flip-flop and the associated transistors is switched, upon energization and de-energization of the electromagnet circuit.

It is another feature of the invention that the electrical circuitry may be mounted on a small printed circuit board and encapsulated with the large electromagnetic as a single unit.

Other objects, features, and advantages of the invention will become apparent from a consideration of the following detailed description and from the accompanying drawings.

BRIEF DESCRIPTION OF THE DRAWINGS

FIG. 1 shows a typical installation of an electromagnetic door lock;

FIG. 2 is an enlarged view of the electromagnetic and its associated strike plate or armature included in the installation of FIG. 1;

FIG. 3 is a simple circuit illustrating the principles of the present invention;

FIG. 4 shows a preferred form of the present invention including a latching relay which draws no current except when the electromagnet is turned on or off; and FIG. 5 shows a semiconductor implementation of a circuit illustrating the principles of the present invention.

DETAILED DESCRIPTION

Referring more particularly to the drawings, FIG. 1 shows a typical installation of an electromagnetic lock including an electromagnet 12 mounted on a door frame 14, with a striker plate or armature 16 mounted on the door 18. FIG. 2 shows the electromagnet 12 and the striker plate 16 in somewhat greater detail, and shows the holes through the assembly which are employed for mounting it. The pole pieces of the E-shaped electromagnet appear at reference numeral 20 in FIG. 2. The electromagnet per se is encapsulated within the plastic molding 22, as shown in FIG. 2. The electromagnet 12 is of substantial size, typically in the order of 2 inches by 3 inches by 10 inches, and may require about 3 watts power. Thus, with 12 volts dc, the electromagnet may draw approximately ¼ ampere, while with a 24 volt circuit, the electromagnet may draw approximately ⅛th ampere. The electromagnet assembly of FIGS. 1 and 2, as described above provides a holding force of approximately 1200 pounds; however, in some cases and for some purposes somewhat lesser force, such as 500 or 800 pounds, would be adequate.

We will now consider the three circuits of Figure 3, 4 and 5, illustrating the principles of the present invention, with FIG. 4 representing the preferred embodiment.

In FIG. 3, the electromagnet 12 is energized from the dc power supply 36 when switching circuit 38 is closed. Incidentally, the switching circuit 38 is shown as a block, as it may include electronic circuitry for controlling a number of doors, or other related systems. The two ends of the magnet coil 12 are coupled to the movable contacts 42 and 44 of a double-pole, double-throw relay, of which the electrical contacts are shown within the dashed line box 46 and the relay coil is shown at 48. The contacts of the double-pole, double-throw relay are designated "NC" to indicate normally closed, or closed when the relay coil 48 is de-energized, and "NO" standing for normally open, which is the state of these contacts when the relay coil 48 is de-energized. Other components shown in FIG. 3 include the capacitor 50 which provides supplemental filtering when the direct current power supply 36 is providing full wave rectified dc pulses rather than a steady dc output. The capacitor 52 is a relatively large size capacitor, the function of which will be described hereinbelow. The diode 54 blocks reverse current surges from the electromagnet 12 which might otherwise damage the electrical circuitry included in the switching circuit 38. In operation, when current is supplied to the circuit when switching circuit 38 is closed, the relay contacts 42 and 44 switch to the normally open pair of contacts 56 and 58 from the normally closed pair of contacts 60 and 62, and current flows through diode 54, contacts 56 and 42 through the magnet coil 12 and back to the power supply through contacts 44 and 58, along lead 64. In addition, the large size capacitor 52 is charged up to the same voltage supplied to the magnet coil 12.

Now, when the circuit is turned off by opening the switch included in switching circuit 38, the relay 48 acts very rapidly, perhaps in the order of 1–3 milliseconds, and the contacts 42 and 44 switch to the normally closed contacts 60 and 62. The large capacitor 52 now discharges through the leads 64 and 72, opposing the "kick-back" current flow from the magnet 12 resulting from the collapsing magnetic field. The size of the capacitor 52 is carefully chosen to completely cancel any residual magnetism which might otherwise be present following turn-off of the magnet coil 12. Incidentally, inductive kick-back is at all times blocked by the diode 54 and is essentially absorbed or cancelled out by current flow from capacitor 52. Using a high speed relay 48, operating in the order of one or few milliseconds, complete and full release of the magnetic lock is effected within 50 milliseconds which essentially appears to be instantaneous to anyone using the door. Residual magnetism is fully cancelled by the action of capacitor 52 as it discharges through the electromagnet coil in the reverse direction. Incidentally, it has been determined that with electromagnets of the type shown in FIGS. 1 and 2, and described hereinabove, for 24 volt actuation, the capacitance should be approximately 15 microfarads, while for 12 volt operation, the capacitance 52 should be approximately 47 microfarads. These values have been determined by careful calculation and measurement to provide a capacitor which fully dissipates all residual magnetism and leaves the electromagnet completely neutral and free of any sticking action. The small capacitor 50, employed for supplemental filtering, may be in the order of 3 microfarads. Diode 54 should be capable of withstanding high voltages of up to 1,000 volts.

FIG. 4 is similar to FIG. 3 and as to the identical circuit components, the same reference numerals have been employed. However, the principal difference is the use of a latching or polarized relay 76 which operates the switch contacts in block 46 in one direction when the circuit is turned on and current flows through the relay winding 76 in one direction, and operates the contacts within block 46 in the opposite direction when the relay 76 is energized in the opposite direction. The now polarized capacitor 78 is included in series with the relay coil 76, as there is no need for current to flow in the latching relay 76 between pulses of opposite polarity. In practice, a positive surge of current is applied to the upper end of relay coil 76 as the unit is turned on, and a reverse pulse involving a surge from transients arising from the initial collapsing field of coil 12, and current flow through circuit 79 to relay coil 76 when the circuit is turned off or released by the opening of the switch included in circuit 38. The additional diode 80 is included to protect the electronics in circuit 38. The polarized relay 76 may be any fast acting polarized relay capable of operation within a few milliseconds, and one such relay is available from Aromat under Part No. DS2ES, DC12 or DC24, for 12 or 24 volts DC.

A third embodiment is set forth in FIG. 5, in which transistors are employed instead of a relay. This has the advantage of extremely fast release speed, but has the disadvantage of the higher cost required for the electronics and the high power transistors. Four transistors Q1 through Q4 are required to replace the double-pole, double-throw relay. In FIG. 5 the four transistors Q1 through Q4 are connected in a bridge configuration. The magnet coil 12 is connected between pairs of emitter-collector transistors, allowing bidirectional current flow. When power is turned on, the switching network, including a flip-flop 86, is activated and the capacitor 52 is charged. Terminals 1 and 2 of the flip-flop 86 supply current to the bases of transistors Q1 and Q4, driving Q1 and Q4 to saturation and therefore allowing current to flow through the magnet coil from 12 from left to right as shown in FIG. 5 of the drawings. When power is cut off, terminals 1 and 2 switch off, which cuts off transistors Q1 and Q4. Terminals 3 and 4 of the flip-flop now provide current to the bases of transistors Q2 and Q3 from capacitor 52, which also discharges in the reverse direction through the magnet coil, providing the elimination of residual magnetism and the accelerated release as discussed above in connection with the prior circuits. Thus, the circuit of FIG. 5 is an effective double-throw, double-pole switch, but implemented by transistors.

In practice, the components of FIG. 4 are mounted on a small printed circuit board 92 which is encapsulated within the body of the high strength plastic material 22, along with the E-shaped magnet (see FIG. 2). The capacitors and the high-speed polarized relay are relatively small in size, with the large capacitor 52 measuring about 0.2 inch in diameter and about 0.4 inch long, and the relay 76 and associated contacts 46 being about the size of an integrated circuit chip. Accordingly, the circuitry of FIG. 4 readily fits on the small circuit board 92, for encapsulation with the large electromagnet.

Various circuits have been proposed heretofore for other applications which have circuit configurations which are similar in certain respects to the present circuits. However, these prior circuits are inappropriate for magnetic locks and do not provide the same function and certainly not on the economical basis provided by applicant's arrangement. Thus, for example, reference is made to S. L. Thomas, U.S. Pat. No. 4,318,155, granted Mar. 2, 1982 and to R. L. Jaeschke, U.S. Pat. No. 3,730,317, granted May 1, 1973, wherein both of the two patents relate to magnetic clutches or magnetic brakes. In the Thomas patent, it is intended that the capacitor 24 perform a function similar to applicants' arrangements relative to the coil 10, but a cumbersome, expensive, and slow acting method appears to have been employed. Concerning the speed of actuation, it appears that capacitor 24 is normally isolated from the supply voltage 12, when the switch 14 is closed to energize the electromagnet 10. It is only after the switch 14 is opened that capacitor 24 is initially charged and then is discharged to cancel out the residual magnetism. Accordingly, the high speed actuation which is a feature of applicants' circuitry is not obtained, and the mode of operation wherein the capacitor is charged in the reverse direction and then employed to immediately cancel out the remnants is not found. Similarly, no kick-back protection appears to be included in the Thomas patent. In addition, an oversize capacitor appears to be required. Concerning the Jaeschke patent, his circuit provides only a crude elimination of residual magnetism by reversing the input power through resistors to the coil rather than by discharging a capacitor so that the precisely right amount of energy is provided to the coil to eliminate residual magnetism. In addition, no provision is made for inductive kick-back suppression, and the Jaeschke circuit is also not designed to provide accelerated release. Accordingly, applicants' present circuits which are directed to the problems involved with electromagnetic door circuits are significantly different from prior proposed circuits for other fields which, although similar to some extent, are directed to other problems, and have correspondingly different circit features.

In conclusion, it is to be understood that the foregoing detailed description and the accompanying drawings relate to illustrative embodiments of the invention. Various changes may be made without departing from the spirit and scope of the invention. Thus, by way of example and not of limitation, different types of switching circuits and relays may be employed to accomplish the disclosed function. In addition, with different voltages, and different size magnet coils, the capacitors employed for providing a cancellation voltage may be changed correspondingly in value to precisely eliminate residual magnetism. Accordingly, the present invention is not limited to that precisely as shown in the drawings and as described in the detailed description set forth hereinabove.

What is claimed is:

1. A high speed electromagnetic door control circuit comprising:

an electromagnet lock assembly means for holding a door closed solely by magnetic force, said electromagnetic lock assembly means including a strike plate or armature and electromagnet means for exerting a pull in the order of 800 pounds or more on the strike plate, said electromagnet lock assembly including means for mounting said strike plate and the electromagnet means on a door and in a mating location on a door frame, respectively, with the strike plate and the electromagnet means directly engaging one another as the door is swung closed;

high speed double-throw, double-pole relay switch means for alternately connecting said electromagnet to a first or a second circuit, said relay switch means having a speed of operation in the order of a few milliseconds or less;

means for supplying rectified current to said electromagnetic means in one direction through said first circuit;

a large capacitor means for discharging through said electromagnet means in the opposite direction via said second circuit to fully cancel out the residual magnetism which would otherwise be present after turning said electromagnet off;

means for charging said large capacitor means up to the voltage applied to said electromagnet means when said electromagnet means is being energized through said first circuit; and circuit means for operating said relay switch means to switch said electromagnet means from said first circuit to said second circuit within a few milliseconds from the time when the power to the system is cut off;

whereby an opposite voltage from said capacitor means equal in magnitude to that normally applied to said electromagnet means, is applied to the electromagnet means to fully reverse the magnetic domains included in it and permanently prevent residual magnetism build-up.

2. An electromagnetic door control circuit as defined in claim 1 wherein said relay is a bistable latching polarized relay, capacitor means are connected in series with the coil of said relay, and circuit means are provided for pulsing said relay coil in one direction as said electromagnet means is turned on, and in the other direction as said electromagnet means is turned off.

3. An electromagnetic door control circuit as defined in claim 1 wherein said relay is a latching relay having two switching states, and means are provided for switching it to one switching state when said electromagnet means is turned on and to the other switching state when the electromagnet means is turned off.

4. An electromagnetic door control circuit as defined in claim 1 including means for encapsulating said capacitor and said relay with said electromagnet means.

5. An electromagnetic door control circuit as defined in claim 1 further comprising an input filter capacitor and diode means for blocking current surges from said door control circuit.

6. A high speed electromagnetic door control circuit comprising:

an electromagnet lock assembly means for holding a door closed solely by magnetic force, said electromagnetic lock assembly means including a strike plate or armature and electromagnet means for exerting a pull in the order of 500 pounds or more on the strike plate, said electromagnet lock assembly including means for mounting said strike plate and the electromagnet means on a door and in a mating location on a door frame, respectively, with the strike plate and the electromagnet means directly engaging one another as the door is swung closed;

switching means for alternately connecting said electromagnet means to a first or a second circuit, said switching means having a speed of operation in the order of a few milliseconds or less;

means for supplying rectified current to said electromagnet means in one direction through said first circuit;

a large capacitor means for discharging through said electromagnet means in the opposite direction via said second circuit to fully cancel out the residual magnetism which would otherwise be present after turning said electromagnet means off;

means for charging said large capacitor means up when said electromagnet means is being energized through said first circuit; and circuit means for operating said switching means to switch said electromagnet means from said first circuit to said second circuit within a few and less than ten milliseconds of the time when the power to the system is cut off;

whereby an opposite electrical pulse from said capacitor is applied to the electromagnet means to fully reverse the magnetic domains included in it and permanently prevent residual magnetism build-up.

7. An electromagnetic door control circuit as defined in claim 6 wherein said switching means is a bistable latching polarized relay, capacitor means are connected in series with the coil of said relay, and circuit means are provided for pulsing said relay coil in one direction as said electromagnet means is turned on, and in the other direction as said electromagnet means is turned off.

8. An electromagnetic door control circuit as defined in claim 6 wherein said switching means is a latching means having two switching states, and means are provided for switching it to one switching state when said electromagnet means is turned on and to the other switching state when the electromagnet means is turned off.

9. An electromagnetic door control circuit as defined in claim 6 further comprising an input filter capacitor and diode means for blocking current surges from said door control circuit.

10. An electromagnetic door control circuit as defined in claim 9 including means for encapsulating said diode, said capacitors and said switching means with said electromagnetic means.

11. An electromagnetic door control circuit as defined in claim 7 further comprising an input filter capacitor and an input diode means for blocking current surges, and additional diode means coupled between said large capacitor and said input capacitor to prevent reverse current flow.

12. An electromagnetic door control circuit as defined in claim 11 including means for mounting said capacitors, diodes, and switching means and encapsulating them along with said electromagnet means.

13. A high speed electromagnetic door control circuit comprising:

an electromagnet lock assembly means for holding a door closed solely by magnetic force, said electromagnetic lock assembly means including a strike plate or armature and electromagnet means for exerting a pull in the order of 500 pounds or more on the strike plate, said electromagnet lock assembly means including means for mounting said strike plate and the electromagnet means on a door and in a mating location on a door frame, respectively, with the strike plate and the electromagnet means directly engaging one another as the door is swung closed; and operating and control circuit means for said electromagnet means for releasing said electromagnet lock assembly means within 100 milliseconds, consisting essentially of:

(a) switching means for alternately connecting said electromagnet means to a first or a second circuit, said switching means having a speed of operation in the order of a few milliseconds or less;

(b) means for supplying rectified current to said electromagnet means in one direction through said first circuit;

(c) large capacitor means for discharging through said electromagnet means in the opposite direction via said second circuit to fully cancel out the residual magnetism which would otherwise be present after turning said electromagnet means off;

(d) means for charging said large capacitor means up when said electromagnet means is being energized through said first circuit; and (e) circuit means for operating said switching means to switch said electromagnet means from said first circuit to said second circuit within a few milliseconds of the time when the power to the system is cut off and before the current through siad electromagnet has died down;

whereby an opposite electrical pulse from said capacitor is applied to the electromagnet means to fully reverse the magnetic domains included in it and permanently prevent residual magnetism build-up and permit release of said electromagnetic lock assembly means in 50 milliseconds or less.

14. An electromagnet control circuit as defined in claim 13 including means for mounting said capacitors, diodes, and switching means and encapsulating them along with said electromagnet.

15. An electromagnetic door control circuit as defined in claim 13 wherein said switching means is a bistable latching polarized relay, capacitor means are connected in series with the coil of said relay, and circuit means are provided for pulsing said relay coil in one direction as said electromagnet means is turned on, and in the other direction as said electromagnet means is turned off.

16. An electromagnetic door control circuit as defined in claim 13 wherein said switching means is a latching means having two switching states, and means are provided for switching it to one switching state when said electromagnet means is turned on and to the other switching state when the electromagnet means is turned off.

* * * * *